US007665233B2

(12) United States Patent
Lemieux et al.

(10) Patent No.: US 7,665,233 B2
(45) Date of Patent: Feb. 23, 2010

(54) SELF POWERED LANDSCAPING ATTACHMENT FOR VEHICLE

(75) Inventors: William T Lemieux, Lyman, ME (US); Robert J Pittman, Beverly, MA (US)

(73) Assignee: Ponderosa Properties, LLC, Dover, NH (US)

( * ) Notice: Subject to any disclaimer, the term of this patent is extended or adjusted under 35 U.S.C. 154(b) by 0 days.

(21) Appl. No.: 12/268,554

(22) Filed: Nov. 11, 2008

(65) Prior Publication Data

US 2009/0119954 A1 May 14, 2009

Related U.S. Application Data

(60) Provisional application No. 60/987,190, filed on Nov. 12, 2007.

(51) Int. Cl.
*E01H 5/04* (2006.01)

(52) U.S. Cl. ..... 37/236

(58) Field of Classification Search ..... 37/231–236, 37/266, 348, 382; 172/2–12; 701/50; 303/7, 303/123, 162
See application file for complete search history.

(56) References Cited

U.S. PATENT DOCUMENTS 4,403,432 A 9/1983 Biance
4,999,935 A * 3/1991 Simi et al. ..... 37/236
5,046,271 A 9/1991 Daniels
5,265,355 A 11/1993 Daniels
5,524,368 A * 6/1996 Struck et al. ..... 37/235
5,595,007 A 1/1997 Biance
5,930,922 A 8/1999 Altheide
6,151,809 A 11/2000 Altheide
6,163,985 A * 12/2000 Chinnery et al. ..... 37/234
6,408,548 B1 6/2002 Altheide
7,114,786 B2 * 10/2006 Bess et al. ..... 303/7

* cited by examiner

*Primary Examiner*—Robert E Pezzuto
(74) *Attorney, Agent, or Firm*—Vern Maine & Associates

(57) ABSTRACT

A snowplow or other landscaping implement for mounting by a single point attachment such as a trailer hitch receiver on a host platform or the rear of a vehicle. The implement includes a main battery for intermittently powering a mechanical actuator or blade lifting mechanism where the functions are remotely controlled by the vehicle or host platform operator controlling at least one solenoid for switching on main battery power when needed. There is also a main battery trickle charging system connectible for power to an electrical circuit on the host platform or vehicle through a connector, and configured to draw only a limited level of current only when the main battery needs it and the source electrical circuit can readily provide it.

19 Claims, 2 Drawing Sheets

SELF POWERED LANDSCAPING ATTACHMENT FOR VEHICLE

This application relates to and claims the benefit of, for all purposes, pending U.S. application Ser. No. 60/987,190 filed Nov. 12, 2007.

FIELD OF INVENTION

The invention relates to landscaping equipment attached to and used in conjunction with a host vehicle, and more particularly to landscaping implements with power requirements, mounted by a single point attachment to a trailer hitch receiver and related electrical connector.

BACKGROUND OF THE INVENTION

Landscaping tools and construction equipment intended to be removably attached to host vehicles for use include but are not limited to sweepers, mowers, blowers, rollers, cultivators, post hole diggers and drivers, compressors, trimmers and plows, including snowplows. Such articles of equipment, sometimes referred to generically as attachments, are usually attached to the front, side or rear of a host vehicle such as a truck or tractor, and supported in use by the host vehicle. Some implements require host vehicle motion as part of their primary functionality, such as sweepers, snowplows and lawn mower attachments. Others are supported during stationary primary functionality and transported between events of primary functionality, such as posthole digger and driver attachments that are moved from hole to hole during the course of the work. Many such implements incorporate by necessity the ability to be structurally or mechanically reconfigured during usage or between events of primary usage, either by manual or powered adjustment of some aspect of the implement, such as for position, orientation, size, or range of motion adjustments.

Manual adjustments are often inconvenient and sometimes difficult or strenuous undertakings, particularly if they require a dedicated operator or the host vehicle operator to move back and forth from the vehicle operator station to the attachment.

Vehicle powered implement adjustments, particularly with controls positioned for vehicle operator convenience, are common, such as for front mounted snow plows with lift and tilt functions powered through high pressure hydraulic hoses from an engine-driven hydraulic pump. Other such implements or attachments may use engine power directed to a rotary shaft output called a power take-off (PTO), or be electrically powered by electrical cables extending from the host vehicle electrical system. Mechanical adjustments on towed landscaping, construction or farming implements such as rakes, planters, harrows, tillers, and bailers, may be similarly powered or alternatively driven by a separate, on-board power source such as a diesel or gasoline engine. Controls for such equipment may be provided or extended to the host or towing vehicle operator by electrical cables or mechanical linkages extending from the implement to the vehicle.

It is known to have snow plow attachments vertically rotationally mounted by two points horizontally displaced on a special support frame or carriage permanently installed under the front of a host vehicle such that the plowblade can be lifted and lowered by a separate, vehicle-mounted, powered lifting mechanism. The most common form of lifting mechanism is a separate assembly from the removable plow assembly that is incorporated into or permanently installed on the host vehicle, often on a vertically extending portion of the special support frame, where only the actual plow assembly is removed from the host vehicle between plowing operations and reattached when needed.

The lift mechanism is commonly a hydraulic piston attached by its base to the truck frame or special support frame so as to operate a lever, the base of which is rotationally attached to the special support frame. The plow assembly is connected at the two vertically pivotal, horizontally displaced, attach points on the under carriage or special frame. The forward extending lifting end of the lift lever is attached by a chain to the plow assembly. Hydraulic pressure for the piston is supplied by a hydraulic pump which in turn is driven by either the host vehicle's engine or an electric motor powered by the vehicle's electrical system. There may be additional pistons on the plow assembly for altering the plow angle between left and right side plowing angles, or into a V shape for shedding plowed material to both sides of the vehicle path. Hoses to these pistons are required to be connected to the host vehicle hydraulic pump system each time the plow is attached, and disconnected for removing the plow.

Operator controls for the lift mechanism are generally permanently installed on the host vehicle. This usually requires some modification of the vehicle to accommodate the required cables and control panel. The permanent installation of the special two-point mounting support frame and lift mechanism, and the control system, is usually performed by a professional at considerable cost. Removing and reinstalling these permanent components on another vehicle is problematic, so the plow system is dedicated to and limited to use with a particular host vehicle.

To that end, plowing implements have been developed that can be easily attached to the rear of any suitable vehicle, by use of a simple, one point attachment to a frame mounted box receiver with which many vehicles are fitted as original equipment or added for other reasons such as towing trailers. Box receivers are primarily designed for accepting a trailer hitch for towing trailers, and as such are securely attached to the vehicle frame for strength and rigidity, and are able to support a rear mounted snow plow. Simple plow mechanisms that provide for self alignment to the left or right side plowing angles as they are pulled, require no external power to adjust in that respect. Manually operated lift mechanisms, or linkages extending to the host vehicle have been used for lifting the plowblade of such implements.

Vehicles equipped with box receivers for pulling trailers as are commonly further equipped with an electrical connector through which trailer lights are connected in parallel with vehicle lights, for example tail lights, turn signals and brake lights. These vehicle lighting circuits are normally limited in their current requirements, and wired accordingly, and trailer light circuits connected to these host vehicle lighting circuits can not cumulatively draw more current than the design limits.

There has thus far not been offered a solution to the lift mechanism for a rear mounted plow that is as convenient as the front end permanent installation described above. A permanent installation of a lift mechanism on the back end of a vehicle is problematic, as important access to cargo space would be obstructed. The expense is significant, and the requirement for a dedicated vehicle is a further obstacle to convenience, flexibility of operations, and economy.

SUMMARY OF THE INVENTION

In one aspect, the invention is characterized as a self powered landscaping, construction or farming equipment, attachment or implement that is quickly and removably attachable by one point of attachment to a host vehicle for physical support and mobility, such as to a box receiver on the back of a tractor, pickup truck or sport utility vehicle. The implement or attachment may in the alternative be attachable to and supported by a stationary support or a floating support platform or waterborne vehicle. "Self powered" in the context of this disclosure means the attachment is equipped with its own dedicated, onboard, electrical power source for supplying current for an onboard electrical actuators or motors configured for powering a necessary mechanical motion or adjustment to the equipment, such as by driving a hydraulic pump that operates a hydraulic piston for operating a lifting lever. Other motorized mechanisms for making mechanical adjustments to the equipment configuration are within the scope of the invention. The electrical power source may optionally be used for lighting, electronics, sensors, wireless communications and control, or other light duty electrical accessories or relays as well, so long as the current capacity of the host system is not exceeded.

In one aspect of the invention, the onboard, electrical power source consists of a battery or batteries and a charging system that functions fully independent of the host vehicle, providing power during operations while the equipment is attached to the host vehicle, and being rechargeable while detached from the host vehicle between operations. Power consumed is restored to the battery system between operations by placing the implement in a convenient location and connecting the charging system to a local outlet for line power.

Heavy current draw or power consumption of the onboard mechanical adjustment mechanisms in some landscaping implements during usage is typically intermittent in nature, as for example when the lift pump of a snowplow is cycled at the end of each pass of a multi-pass plowing job to lift the plow for back tracking or repositioning of the vehicle for the next pass. With this in mind, it will be understood that an optional means of extending or maintaining battery charge is to trickle charge the battery or battery pack from the host vehicle trailer hitch lighting or electric brake circuit during operations. The trailer light circuit of a host vehicle is not usually wired for or able to supply a high level of electrical current, but is normally sufficient for a continuous low level current draw. Some vehicles equipped for towing larger trailers have a separate higher capacity electric brake circuit available through the trailer connector. A suitable charging circuit on the battery pack makes either of these an alternative means of extending the running time of the equipment. It is desirable to monitor and control the charging circuit so as to avoid damage to either the host electrical system or the implement electrical system. It is desirable to have a default mode protecting the host vehicle electrical system from damage and allowing the implement battery to be used until discharged. A host electrical system may be a typical engine alternator supported, battery-based D.C. electrical system such as found on most cars and trucks; or it may be an A.C. system more typical of stationary support structures and buildings.

Since landscaping equipment of the invention is self-powered in the manner described, no power cables or mechanical force linkages are needed between the vehicle and the landscaping equipment. A control cable or wireless control link may be utilized to actuate the self-powered features of the equipment, but does not require permanent installation in or modification to the host vehicle. This means that a self-powered implement or equipment of the invention, for which the batteries are adequately charged, can be readily attached to any vehicle equipped with a suitable box receiver, with wired or wireless controls remoted to the vehicle operator's position, and used in the intended manner.

According to another aspect of the invention there is provided a snowplowing implement comprising a plow blade and supporting frame, the frame intended to be mounted by a single point attachment to a box style receiver hitch on the rear end of a host vehicle for support of the plowblade and mobility of the implement in use. The implement may incorporate the side to side tilting technology of Biance's U.S. Pat. No. 5,595,007, which is hereby incorporated in its entirety by reference. The implement is improved by the addition of an onboard electrical battery pack and battery charging system, and a battery powered motion mechanism, whereby the snowplow implement is self powered for lifting and lowering of its blade with respect to its support frame when its frame is attached to a support structure or host vehicle. The snowplow attachment may be optionally configured for powered rotation of the blade for left or right side plowing and/or V plowing during plowing operations as is well known in the art; the power for these adjustments according to the invention being provided manually, or by the Biance method, or by the onboard battery system and suitable D.C. powered motion actuators. The charging system or charging subsystem of the implement electrical system may be connectible to line power for recharging the battery between plowing or other landscaping operations.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
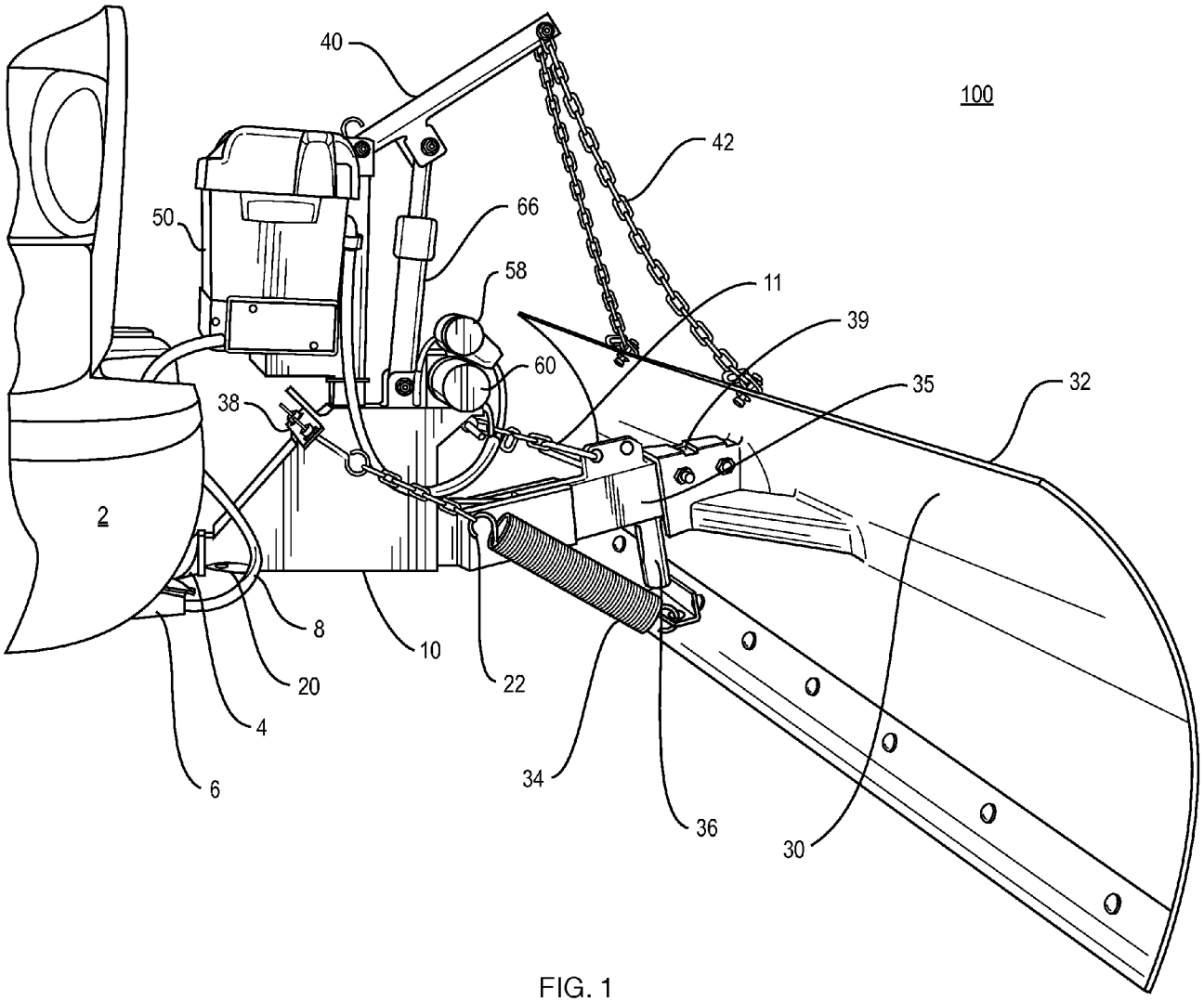
FIG. 1 is a perspective side view of an embodiment of the invention, showing a plow implement attachable to a host vehicle, including a plow blade, a battery, an electrically powered motor, hydraulic pump and piston supporting a lifting lever attached to the plow blade.

FIG. 1 is a perspective side view of a snow plow implement 100 configured for single point attachment to a support platform or the rear of a host vehicle 2. The snow plow implement consists of a main frame 10, terminating at a forward end with a shaft hitch 20 that is insertable into a standard two inch box receiver 4 on the back of vehicle 2, which might for example be a truck or SUV. Plow blade assembly 30 is rotatively attached to the rear end of frame 10 by support arm 35 at vertical pivot point 22, so as to provide a point of rotation for lifting and lowering of the plowblade 32 with respect to frame 10. Helper springs 34 connect the lower end of spring lever 36, extending from support arm 35, to attach points 38 on main frame 10. When the plow blade is lifted and lowered, the tension line of springs 34 passes over center of pivot point 22, so as to provide downward biased spring tension on the blade when the blade is in the down position A retaining clip 11, attached to main frame 10, is attachable to support arm 35 to secure the blade in an up position for transit.

The forward point of attachment 39 of support arm 35 to plow blade 32 may be a simple, rigid attachment or it may incorporate the side to side self aligning feature of Biance's U.S. Pat. No. 5,595,007, as previously discussed. In other embodiments, it may incorporate manual or powered adjustment features, not shown here but well known in the art, for changing blade geometries to suit the user's requirements.

Figure 2:
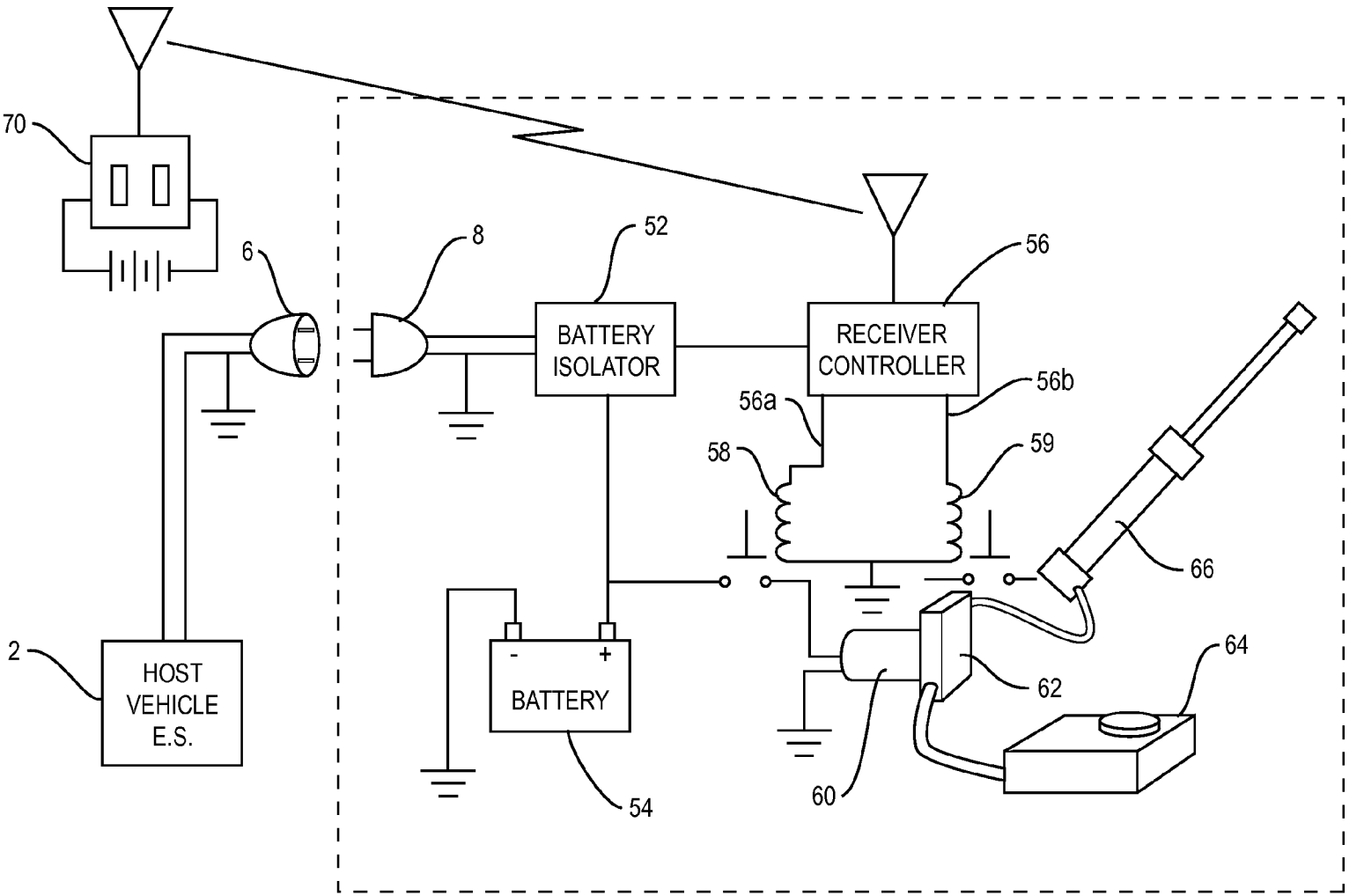
FIG. 2 is a simplified system diagram of the electrical and hydraulic systems of the embodiment of FIG. 1.

FIG. 2 provides a diagrammatic representation of the electrical and hydraulic circuits of the embodiment of FIG. 1. Referring to both FIGS. 1 and 2, major components of the implement electrical system are housed in enclosure 50, which is securely mounted to frame 10. Major components include a battery isolator 52, and a power battery 54, which powers wireless receiver controller 56 co-located in the enclosure. Electrical cables extending from enclosure 50 connect battery 54 via the normally open contacts of a motor solenoid 58 to motor 60 for power. Separate control wires 56*a* and 56*b* on wireless receiver controller 56 extend from enclosure 50. Control wire 56*a* is connected to the coil of motor solenoid 58 to control power to motor 60, which powers hydraulic pump 62. Control wire 56*b* is connected to hydraulic pump solenoid 59, which operates a normally closed hydraulic dump valve incorporated with pump 62 to release fluid from hydraulic piston 66. When motor 60 is actuated by a control output of wireless receiver controller 56, pump 62 pumps hydraulic fluid from fluid reservoir 64 into hydraulic piston 66 to raise lift lever 40, which is connected by chains 42 to plow blade 32. A control output to open the valve in pump 62 permits piston 66 to retract under the weight of plow blade 32, forcing fluid back into reservoir 64.

Control outputs are elicited from wireless receiver controller 56 by signals received from handheld wireless transmitter 70, which is battery powered in this embodiment and has a transmitting range suitable to the vehicle and implement configuration. Transmitter 70 in this embodiment has two simple input buttons, one for "up" which actuates motor solenoid 58, and one for "down" which actuates valve solenoid 59. Other embodiments for control of the implement, including bidirectional wireless or wired signals for control and information feedback such as plow height or angle or other useful indicator of implement configuration or condition to the operator, are within the scope of the invention.

Support platform or host vehicle 2 is equipped with an electrical receptacle 6 connected to an internal vehicle lighting circuit or electric trailer brake circuit or other electrical power source. On implement 100, there is an electrical system cable and connector assembly 8 connected to battery isolator 52 in enclosure 50, the plug end being extendable so as to be plugged into connector 6 on the host vehicle, where when vehicle tail lights are illuminated, surplus power up to the capacity of the lighting circuit is available to battery isolator 52 for charging battery 54. Battery isolator 52 is in this embodiment, an intelligent device that senses the condition of both the host vehicle lighting circuit and power source, and the condition of battery 54, and permits low level charging current, limited to 10 amps in this embodiment, to enter battery 54 only when current is readily available from the host system and required by battery 54. The implement 100 is thus able to be trickled charged continuously while connected to the host vehicle, and is able to intermittently discharge higher current levels to lift the plow blade when required, while the host vehicle electrical system is thus protected at all times from excessive current draw by the implement 100.

Moreover, the implement electrical system is compatible with substantially all conventional trailer hitch and lighting connector setups, so that the implement in its snow plow embodiment can be fairly characterized as a "plug and plow" device, useable on any vehicle equipped for pulling and illuminating a trailer.

Other types of self powered landscaping implements attachable to a suitable support platform or host vehicle for and requiring trickle charging to maintain capability of intermittent higher power requirements are within the scope of the invention.

The invention is susceptible of other embodiments. For example, there is a landscaping or construction implement intended to be mounted by a single point attachment to a trailer hitch receiver on the front, side, or rear end of a host vehicle or support platform, where the implement is improved by addition of a battery and battery charging system, whereby a motion actuator or motorized mechanical adjustment on the implement is powered by the battery for intermittently altering the mechanical configuration of or otherwise providing higher than charging current to the implement during landscaping or construction operations, and the charging system may be connected to line power or host vehicle power for trickle charging the battery during or between operations.

The implement may be configured with running lights or electronics or other light load electrical accessories that are also powered by the battery system. The implement may be configured with a receiver for wireless remote control of the onboard battery powered functions and/or sensors and a transmitter for emitting data communications relating to the operation or condition of the implement, the battery system, or external factors.

The invention is susceptible of other and numerous examples, equivalents, and embodiments. For example, there is a landscaping implement attachable to and operable in combination with a host platform, consisting of: a main frame having at least one point of mechanical attachment to the host platform; a main battery; an actuator powered by the main battery and controlled by an operator control device; and a main battery charging system connectible by an electrical connector to a mating receptacle of the host platform electrical system and configured for limiting electrical current draw from the host platform electrical system to less than the current draw of the actuator from the main battery.

The full weight of the implement may be supportable by the at least one point of mechanical attachment. The host platform may be a host vehicle. The point of attachment may be a four sided shaft for insertion into a box receiver mounted on the host platform or vehicle.

The charging system may be configured to limit the current draw from the host platform electrical system to not more than 30 amps. The charging system may have circuitry permitting current draw from the host platform electrical system only when the main battery requires it and the host platform electrical system is able to provide it, so as to isolate and give priority to or protect the host electrical system over the implement electrical system.

The implement may be a snowplow, and the actuator may be a blade lifting mechanism. The blade lifting mechanism may consist of an electric motor driving a hydraulic pump that fills a piston with fluid from a fluid reservoir, the extension of the piston lifting a lever attached by chains to a snow plow blade whereby operation of the motor lifts the snow plow blade.

The operator control device may be an operator's wireless control transmitter powered by an internal battery, and a wireless receiver controller on the implement powered by the main battery. One output of the receiver controller may be connected to a motor power solenoid whereby main battery power may be switched to the motor for lifting the blade. Another output may be connected to a hydraulic valve solenoid by which a valve is opened and fluid in the piston is released and routed to a fluid reservoir, whereby the valve may be opened for allowing the blade to descend.

The blade may be attached to the main frame by means of a side to side self aligning blade system based on distribution of loading along the face of the blade as the vehicle is moving the blade forward. The charging system may be further configured for receiving AC line power for charging the main battery when the implement is not attached to the host vehicle or the vehicle is parked and not running.

The actuator may be multiple actuators of the same or various types, depending on the implement type and functions. For example, there may be rotary devices, linear motion devices, screw type mechanisms, scissor mechanism, to name only a few. There may be sensors such as GPS (Global Positioning System receiver), limit switches, light sensors, pressure switches, current sensors, motion detectors and/or other common sensors on the implement for sensing data about operating parameters such as location, speed and direction of the implement or of actuators or tools mounted on or to the equipment. There may be a computer or micro processor on the implement and/or in the operator control device. The implement and/or the operator control device may be configured for displaying operating parameters.

The electrical connection of an implement to a host may be a multi-conductor connection to an existing electrical circuit having not greater than, in some embodiments 10 amps, in other embodiments higher such as up to 30 amps, surplus or additional capacity over host's own requirements available for the implement's charging system. The implement main battery is typically an automotive or marine type storage battery capable of storing power received at a relatively lower current rate and intermittently providing a significantly higher current output for a few seconds at a time such as would be typical to power a vehicle starter motor or other actuator of similar characteristics.

An implement of the invention may be a snowplow, and the actuator a blade lifting mechanism. The blade lifting mechanism may comprise any of commonly know powered lifting mechanisms, as for example an electric motor driving a hydraulic pump that fills a piston with fluid from a fluid reservoir, the extension of the piston lifting a lever attached by chains to the plow blade. In other embodiments an electric motor may power a winch and cable or chain that lifts the blade.

The implement may include an operator's portable wireless control transmitter and a wireless receiver controller mounted on the implement, powered by the main battery, with one controller output connected to a motor power solenoid by which main battery power is switched to the motor for lifting the blade. It may have another output which is connected to a hydraulic valve solenoid by which a valve is opened and fluid in the piston is released and routed to a fluid reservoir, allowing the blade to descend.

The blade may be attached to the main frame by means of a side to side self aligning blade system based on loading on the face of the blade as the vehicle is moving the blade forward.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

Among our claims are:

1. A landscaping implement attachable to and operable in combination with a host vehicle, the host vehicle including a general purpose towing adaptation that includes a mechanical towing attachment point and a towing electrical outlet, the towing electrical outlet having a standard towing connector and a current draw capacity that is suitable for powering at least one of brakes and brake lights typically included with towable accessories, the landscaping implement comprising:

a main frame having at least one point of mechanical attachment that is attachable without modification to the mechanical towing attachment point of the host vehicle;

a main battery;

an actuator powered by the main battery and controlled by an operator control device; and a main battery charging system connectible without modification by an electrical connector to the towing electrical outlet of the host vehicle, and configured for limiting electrical current draw from the towing electrical outlet to less than the current draw capacity of the towing electrical outlet.

2. The implement of claim 1, the full weight of the implement being supportable by the mechanical attachment.

3. The implement of claim 1, the at least one point of mechanical attachment comprising a four sided shaft for insertion into a box receiver included in the towing attachment point.

4. The implement of claim 1, the charging system being configured to limit the current draw from the towing electrical outlet to not more than 30 amps.

5. The implement of claim 4, the charging system comprising circuitry permitting current draw from the towing electrical outlet only when the main battery requires it and the towing electrical outlet is able to provide it.

6. The implement of claim 1, the implement being a snowplow, the actuator being a blade lifting mechanism.

7. The implement of claim 6, the blade lifting mechanism comprising an electric motor driving a hydraulic pump that fills a piston with fluid from a fluid reservoir, the extension of the piston lifting a lever attached by chains to a snow plow blade whereby operation of the motor lifts the snow plow blade.

8. The implement of claim 7, the operator control device comprising an operator's wireless control transmitter, and a wireless receiver controller powered by the main battery, one output of the receiver controller being connected to a motor power solenoid whereby main battery power may be switched to the motor for lifting the blade.

9. The implement of claim 8, the wireless receiver controller further comprising another output being connected to a hydraulic valve solenoid by which a valve is opened and fluid in the piston is released and routed to a fluid reservoir, whereby the valve may be opened for allowing the blade to descend.

10. The implement of claim 9, the blade being attached to the main frame by means of a side to side self aligning blade system based on distribution of loading along the face of the blade as the vehicle is moving the blade forward.

11. The implement of claim 1, further comprising a lighting circuit powered by the main battery.

12. The implement of claim 1, the charging system being further configured for receiving AC line power for charging the main battery.

13. The implement of claim 1, said actuator comprising multiple actuators.

14. The implement of claim 1, further comprising sensors for sensing operating parameters data and a computer for processing operating parameters data, said operator control device being configured for displaying operating parameters.

15. A snowplow implement attachable to and operable in combination with a host vehicle, the host vehicle including a general purpose towing adaptation that includes a towing attachment point and a towing electrical outlet, the towing electrical outlet having a standard towing connector and a current draw capacity that is suitable for powering at least one of brakes and brake lights typically included with towable accessories, the landscaping implement comprising:

a main frame having a four sided shaft for insertion without modification into a box receiver included in the towing attachment point;

a main battery;

a snow plow blade lifting mechanism powered by the main battery and controlled by an operator control device, the blade lifting mechanism comprising an electric motor driving a hydraulic pump that fills a piston mounted to the main frame with fluid from a fluid reservoir, the extension of the piston lifting a lever attached by chains to a snow plow blade pivotally connected to the main frame to accommodate vertical lifting and descending of the blade;

a main battery charging system connectible without modification by an electrical cable and connector to the standard towing connector, configured for limiting electrical current draw from the host vehicle electrical system to not greater than the current draw capacity of the towing electrical outlet, and comprising circuitry permitting current draw from the towing electrical outlet only when the main battery requires it and the towing electrical outlet is able to provide it; and an operator's wireless control transmitter and a wireless receiver controller powered by the main battery, a first controller output of which is connected to a motor power solenoid by which main battery power is switched to the motor for lifting the blade, a second controller output of which is connected to a hydraulic valve solenoid by which fluid in the piston is released and routed to a fluid reservoir, allowing the blade to descend.

16. The implement of claim 15, the blade being attached to a the main frame by means of a side to side blade self aligning system based on a distribution of loading across the face of the blade.

17. The implement of claim 15, further comprising a lighting circuit powered by the main battery.

18. The implement of claim 15, further comprising a securing link whereby the blade can be locked in a lifted position.

19. The implement of claim 15, the charging system being further configured for receiving AC line power for charging the main battery.

* * * * *